US011085619B2

(12) United States Patent
Erel et al.

(10) Patent No.: US 11,085,619 B2
(45) Date of Patent: Aug. 10, 2021

(54) MODULAR LUMINAIRE

(71) Applicant: ABL IP Holding LLC, Atlanta, GA (US)

(72) Inventors: Bulent Erel, Roswell, GA (US); William Pixler, Atlanta, GA (US); Luke J. Siefker, McDonough, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/809,692

(22) Filed: Mar. 5, 2020

(65) Prior Publication Data

US 2020/0284414 A1 Sep. 10, 2020

Related U.S. Application Data

(60) Provisional application No. 62/815,396, filed on Mar. 8, 2019.

(51) Int. Cl.

| | |
|---|---|
| ***F21V 23/00*** | (2015.01) |
| ***F21V 15/01*** | (2006.01) |
| ***F21S 2/00*** | (2016.01) |

(52) U.S. Cl.

CPC ..... *F21V 23/002* (2013.01); *F21S 2/005* (2013.01); *F21V 15/01* (2013.01)

(58) Field of Classification Search

None

See application file for complete search history.

(56) References Cited

U.S. PATENT DOCUMENTS

| | | | | |
|---|---|---|---|---|
| 5,550,725 | A | 8/1996 | Shemitz et al. | |
| 6,905,222 | B1 | 6/2005 | Russello et al. | |
| 8,960,971 | B1 | 2/2015 | Newton | |
| 9,157,619 | B1 | 10/2015 | Newton | |
| D766,485 | S | 9/2016 | Ladewig et al. | |
| 9,702,533 | B1 | 7/2017 | Harpenau et al. | |
| 9,702,539 | B2 | 7/2017 | Scarlata et al. | |
| 9,835,314 | B1 | 12/2017 | Wright | |
| 9,879,849 | B2 | 1/2018 | Kinnune et al. | |
| 10,030,856 | B2 | 7/2018 | Duckworth | |
| 10,228,103 | B1 * | 3/2019 | Zhou | F21L 4/08 |
| 2006/0039168 | A1 | 2/2006 | Mier-Langner et al. | |
| 2009/0129101 | A1 | 5/2009 | Bowden et al. | |
| 2009/0321598 | A1 | 12/2009 | Vann et al. | |
| 2013/0027937 | A1 * | 1/2013 | Winters | F21V 29/713 362/249.01 |
| 2016/0320046 | A1 * | 11/2016 | Duckworth | F21V 21/108 |

(Continued)

*Primary Examiner* — Elmito Breval

(74) *Attorney, Agent, or Firm* — Kilpatrick Townsend & Stockton LLP

(57) ABSTRACT

A luminaire includes an electronics module and a light module attached to the electronics module. The electronics module includes an electronics housing and a cover attached to the electronics housing. At least one alignment extension extends from the electronics housing, and at least one wireway channel may extend through the at least one alignment extension. The light module includes a housing and a light engine with at least one light source and at least one wire. At least one alignment channel is formed in an underside of the housing of the light module, and the at least one alignment extension is positioned within the at least one alignment channel. The at least one wire extends through the at least one wireway channel.

20 Claims, 17 Drawing Sheets

(56) References Cited

U.S. PATENT DOCUMENTS

| | | | | |
|---|---|---|---|---|
| 2016/0327256 | A1 | 11/2016 | Hall | |
| 2017/0030570 | A1* | 2/2017 | Yang | F21V 29/763 |
| 2017/0108184 | A1 | 4/2017 | Brannon et al. | |
| 2017/0108186 | A1 | 4/2017 | Brannon et al. | |
| 2017/0307197 | A1* | 10/2017 | Clark | H05B 45/50 |
| 2017/0370553 | A1 | 12/2017 | Demuynck et al. | |

* cited by examiner

MODULAR LUMINAIRE

REFERENCE TO RELATED APPLICATION

This application claims the benefit of U.S. Provisional Patent Application No. 62/815,396, filed on Mar. 8, 2019, and entitled MODULAR LUMINAIRE, the content of which is hereby incorporated by reference in its entirety.

FIELD OF THE INVENTION

The present invention relates to luminaires, and more particularly to luminaires formed with modular components.

BACKGROUND

Some luminaires are formed with a single housing that houses both the light sources as well as the electrical components that power the light sources. However, manufacturing limitations often limit the size that such fixtures can be. More specifically, it can be difficult to cast housings that are large enough to accommodate larger volumes of light sources and electronics desired and/or required for certain applications, such as illuminating parking lots and green spaces. Moreover, the electrical connections between the light sources and other electronics mounted to other parts of the housing require more exposed wire routing methods which require more complex assemblies for weatherproofing and aesthetic improvement to conceal aesthetically undesirable features required by the weatherproofing components.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings, and each claim.

According to certain embodiments, a luminaire includes an electronics module and a light module attached to the electronics module. The electronics module includes an electronics housing and a cover attached to the electronics housing to form an enclosure within the electronics module. In various aspects, at least one alignment extension extends from the electronics housing, and at least one wireway channel having an opening extends through the at least one alignment extension. The light module includes a housing, which may act as a heat sink. The light module may also include a light engine having at least one light source and at least one wire. At least one alignment channel may be formed in an underside of the housing of the light module. The luminaire may be assembled by positioning the at least one alignment extension of the electronics module within the at least one alignment channel of the light module. In various examples, the light engine may be attached to the underside of the heat sink and extends over at least a portion of the at least one alignment channel so as to conceal the opening of the at least one wireway channel, and the at least one wire extends through the at least one wireway channel.

According to various embodiments, a luminaire includes an electronics module and a light module. The electronics module includes an electronics housing with a housing chamber and a cover attached to the electronics housing such that the housing chamber is enclosed. At least one alignment extension extending from the electronics housing. The light module is attached to the electronics module and includes a housing and at least one alignment channel in the housing. The at least one alignment extension is at least partially positioned within the at least one alignment channel. The light module also includes a light engine with at least one light source, and the light engine is attached to the housing and extends over and covers at least a portion of the at least one alignment channel.

According to some embodiments, a luminaire includes an electronics module and a light module. The electronics module includes an electronics housing with a housing chamber and at least one alignment extension extending outwards from the electronics housing. The at least one alignment extension includes a wireway channel extending through the at least one alignment extension and that is fluid communication with the housing chamber. The light module is attached to the electronics module and includes a housing with at least one alignment channel in the housing. The at least one alignment extension is at least partially positioned within the at least one alignment channel. The light module also includes a light engine with at least one light source and at least one wire, and the at least one wire extends through the wireway channel.

According to certain embodiments, a luminaire includes an electronics module and a light module. The electronics module includes an electronics housing with a housing chamber and at least one alignment extension extending outwards from the electronics housing. The light module is attached to the electronics module and includes a housing and at least one alignment channel in the housing. The at least one alignment extension is at least partially positioned within the at least one alignment channel. The luminaire also includes an alignment rib on one of the at least one alignment extension or the at least one alignment channel and an alignment groove on the other of the at least one alignment extension or the at least one alignment channel such that the alignment rib seats within the alignment groove.

Various implementations described herein can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of features of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Disclosed herein is a luminaire formed of two separate modules—an electronics module and a light module. Mating features on each module facilitate alignment of the modules relative to each other. The mating features may also provide protection against ingress of environmental elements into the luminaire. In some aspects, the mating features may create an integral wireway channel that allows for light sources of the light module to be connected with internal electronics of the electronics module. In various cases, the integral wireway channel may improve ingress protection at the wire entry points into the electronics module and the light module, thereby protecting the wires and electronics of the luminaire. The integral wireway channel may also eliminate or minimize undesirable aesthetics (e.g., exposed hardware or wiring) within requiring additional cosmetic components or parts to conceal the undesirable aesthetic features. Moreover, while individually the electronics module and the light module are of a size compatible with existing manufacturing methods, when assembled together, they form a luminaire of size that can accommodate larger volumes of light sources and electronics necessary for certain applications.

Referring to FIGS. 1-21, in various embodiments, a luminaire 100 includes an electronics module 102 and a light module 104. The light module 104 is selectively mounted onto the electronics module 102 using mating features, which are discussed in greater detail below. It will be appreciated that the particular shape and size of the electronics module 102 and the light module 104 should not be considered limiting on the current disclosure. While light sources of the luminaire 100 are described as light emitting diodes (LEDs), it will be recognized that the invention may be embodied in luminaires using other kinds of light sources, for example fluorescent, incandescent, halogen, etc.

Electronics Housing

Figure 1:
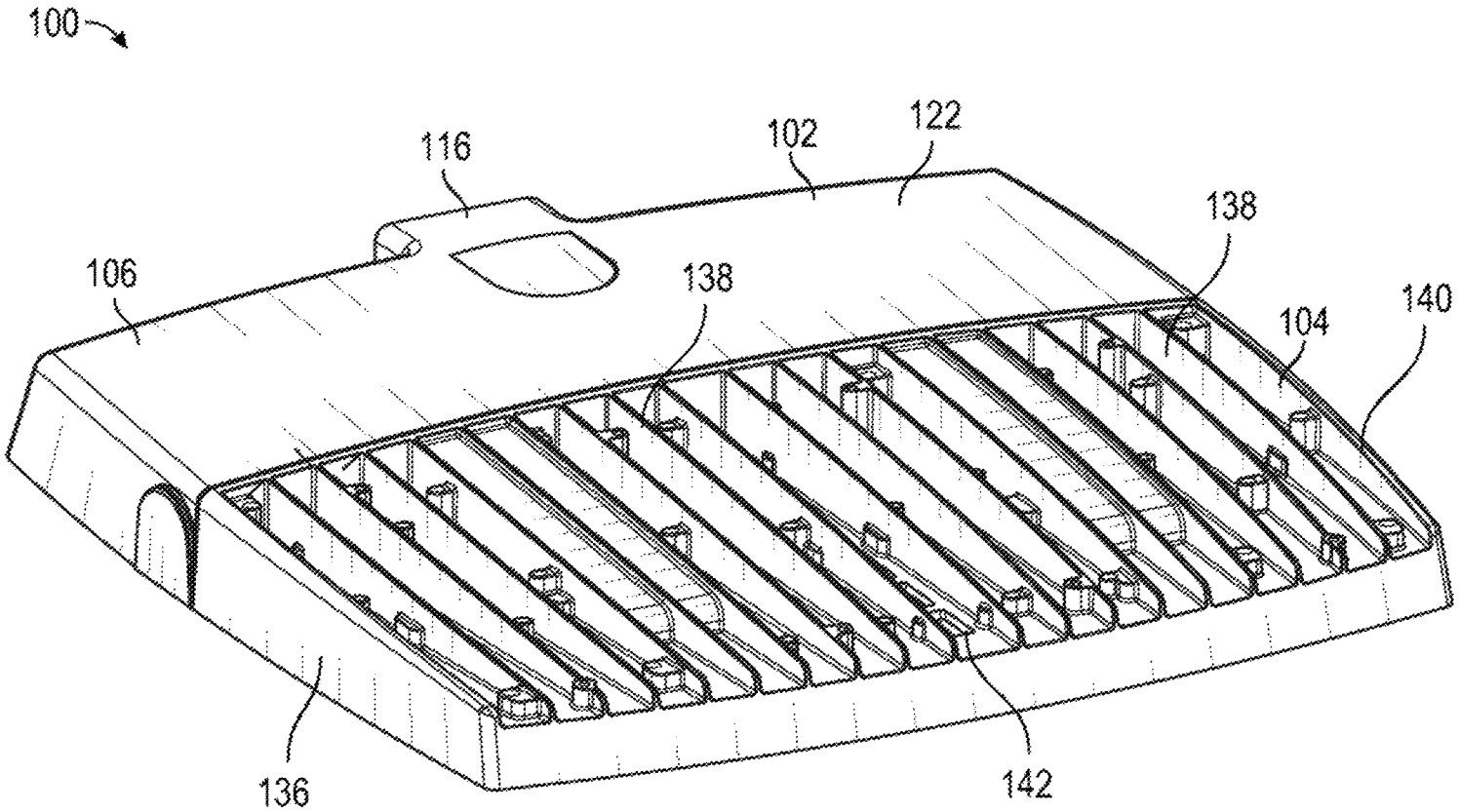
FIG. 1 is a top perspective view of a luminaire with an electronics module and a light module according to embodiments of the disclosure.
Figure 2:
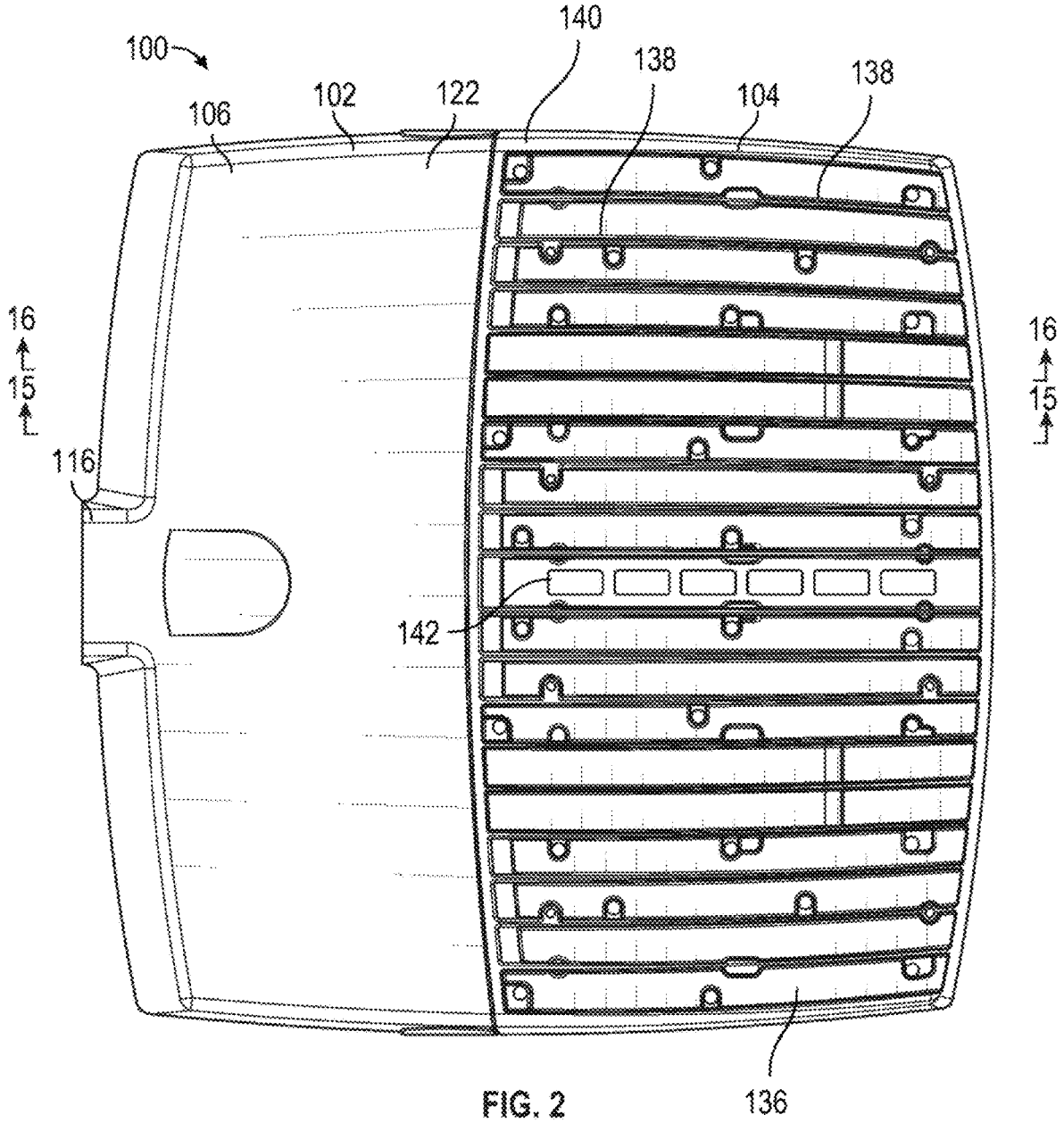
FIG. 2 is a top plan view of the luminaire of FIG. 1.
Figure 3:
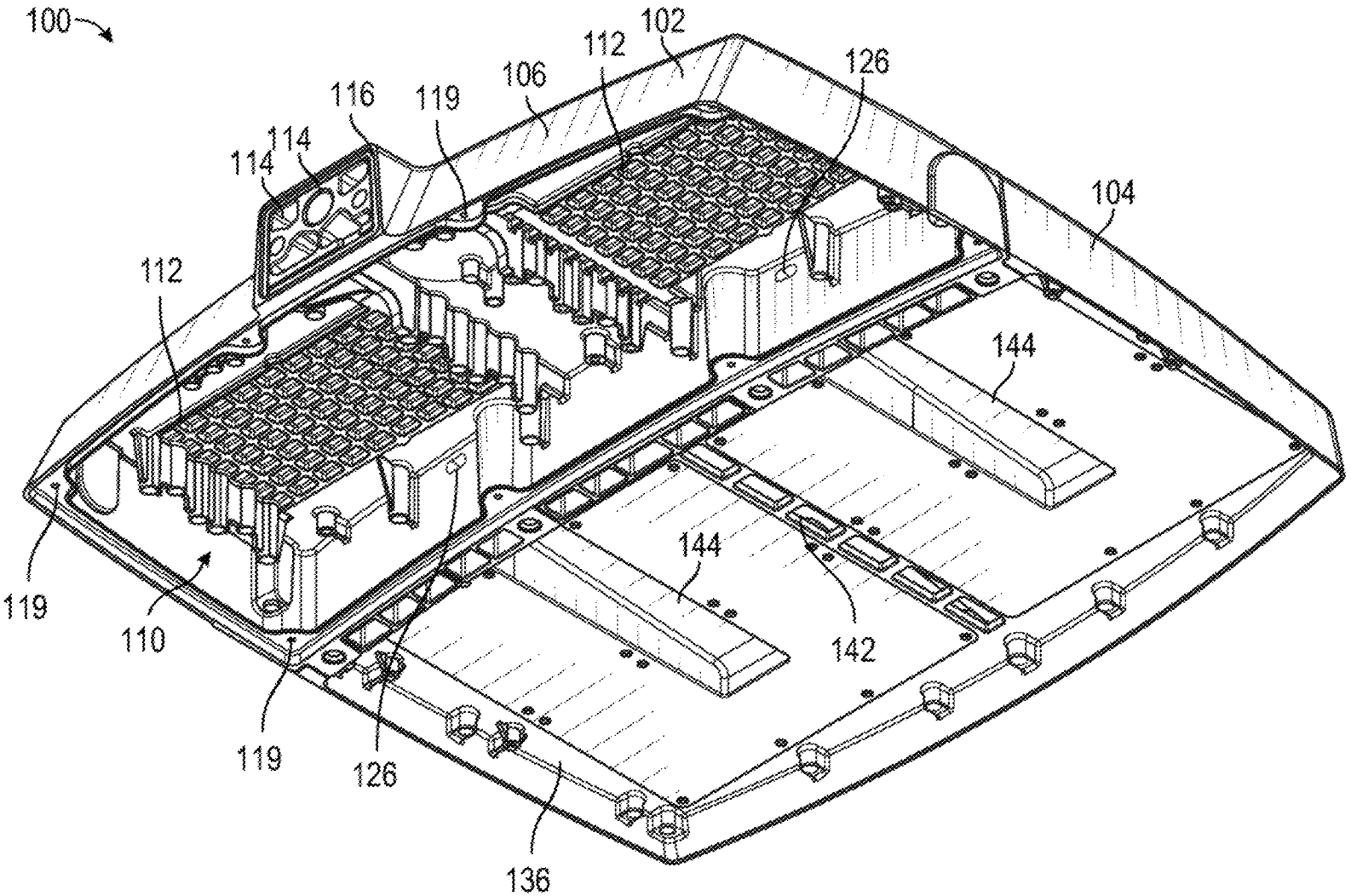
FIG. 3 is a bottom perspective view of the luminaire of FIG. 1 with a cover of the electronics module and light sources of the light module removed for clarity.
Figure 8:
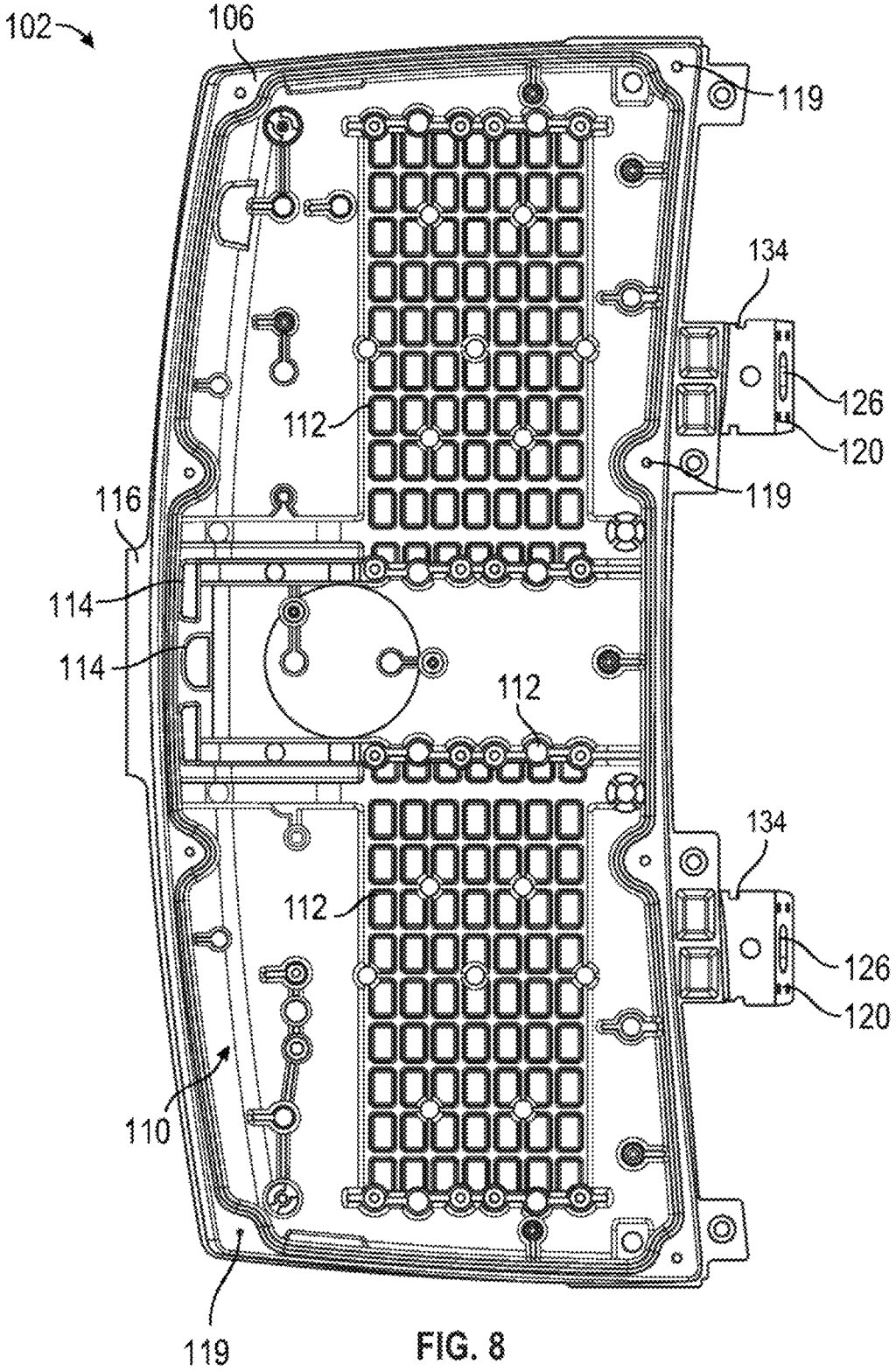
FIG. 8 is a bottom plan view of the electronics module of FIG. 1 with a cover removed for clarity.
Figure 9:
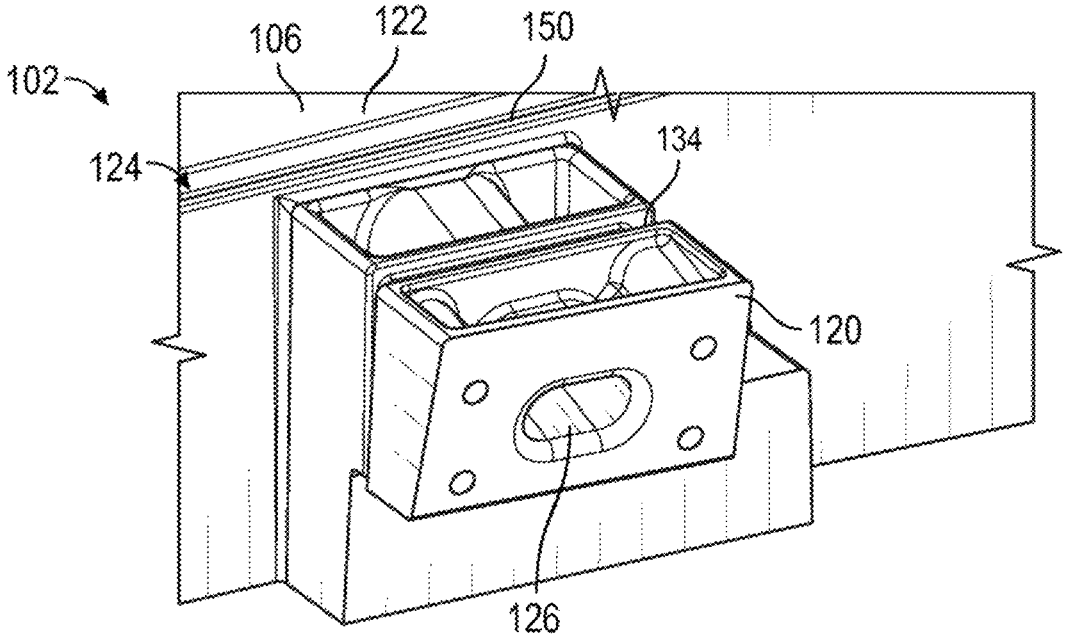
FIG. 9 is a perspective view of a portion of the electronics module of FIG. 1 with a mating feature according to embodiments of the disclosure.
Figure 10:
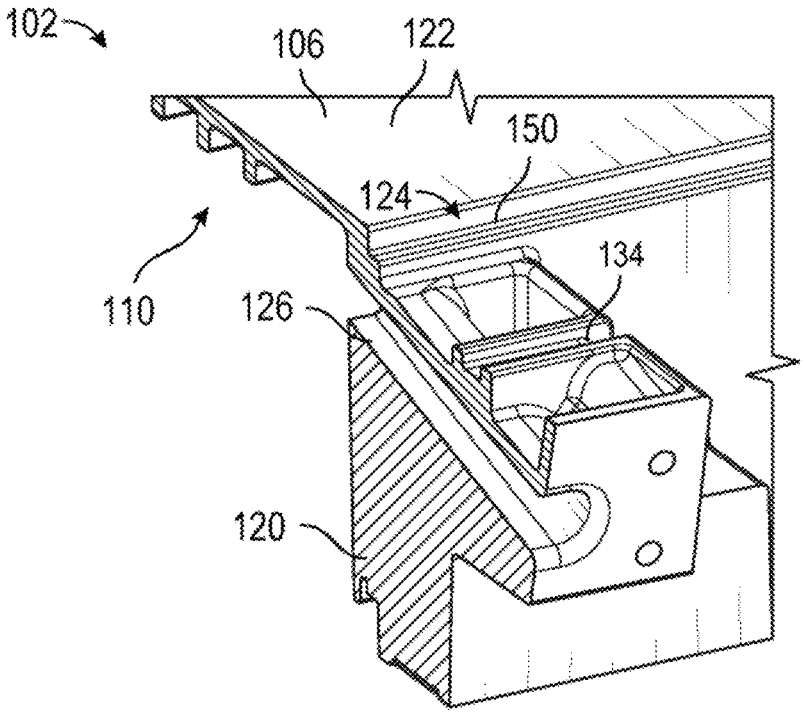
FIG. 10 is a sectional perspective view of the portion of the electronics module with the mating feature of FIG. 9.
Figure 11:
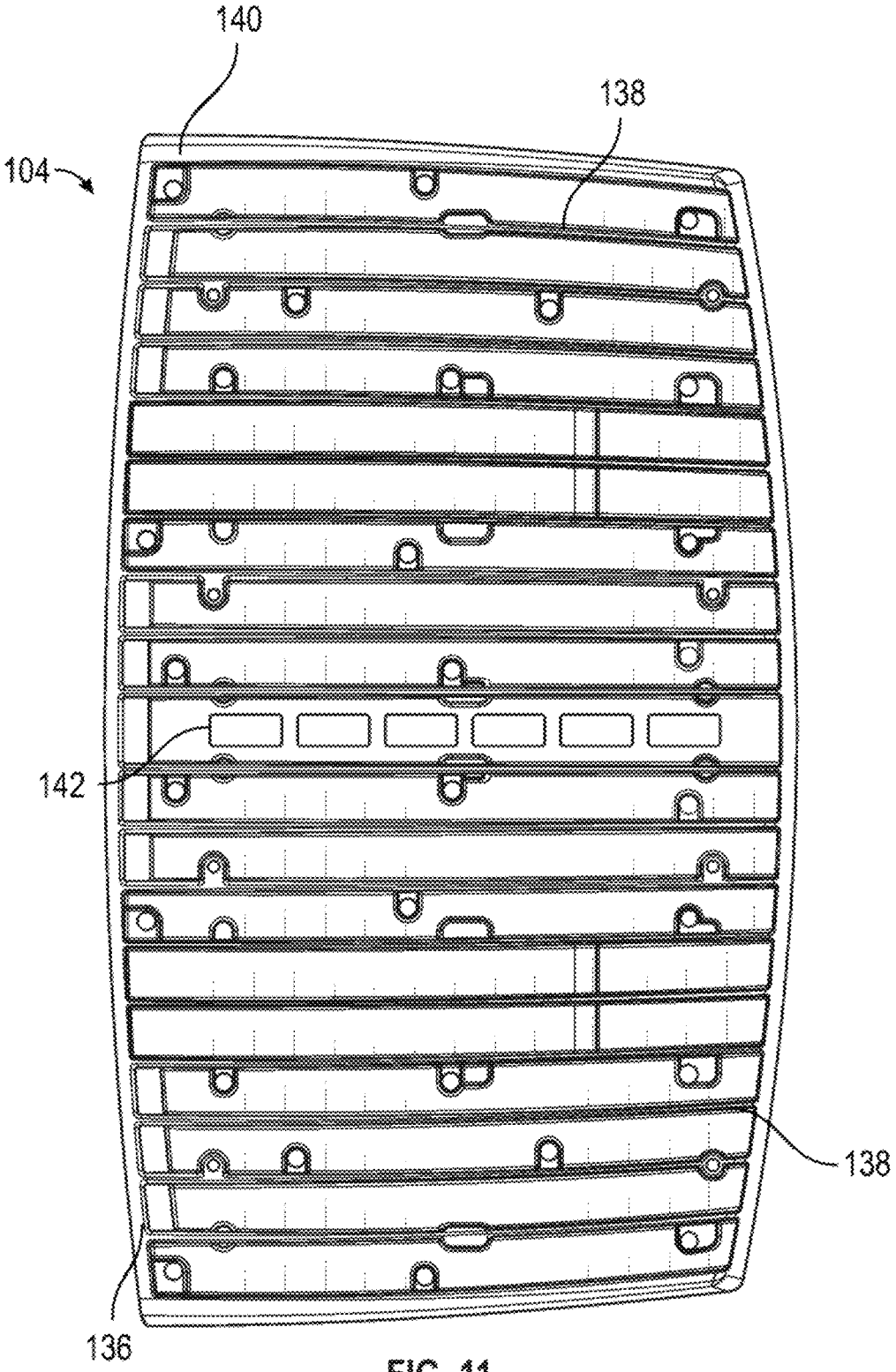
FIG. 11 is a top plan view of the light module of FIG. 1.
Figure 12:
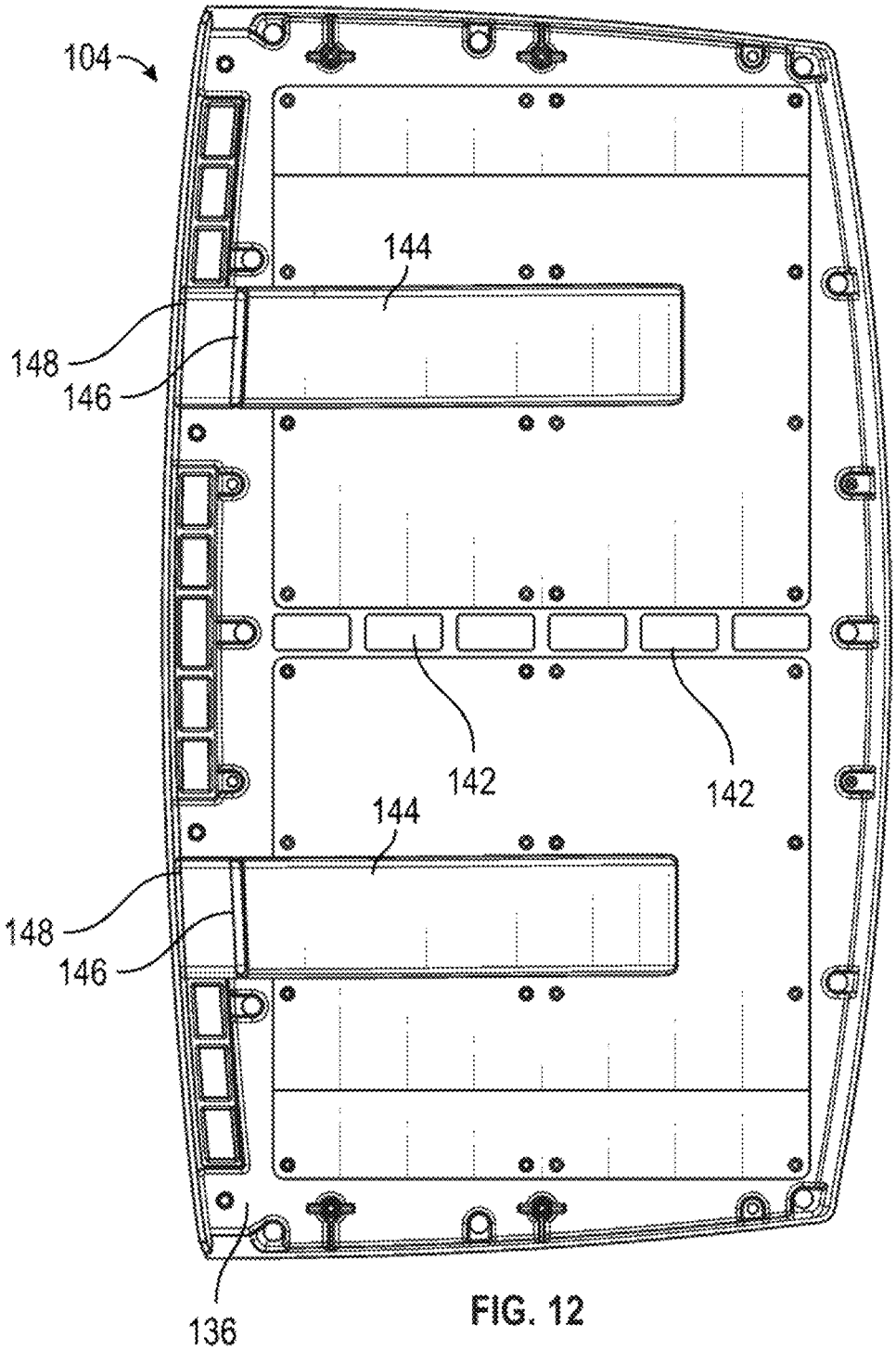
FIG. 12 is a bottom plan view of the light module of FIG. 1 with light sources removed for clarity.

As best illustrated in FIGS. 1-8 and 15-20, in various examples, the electronics module 102 includes an electronics housing 106 and a cover 108, and the electronics housing 106 includes a housing chamber 110. Various electronics (not illustrated) including, but not limited to, a driver, battery pack(s), controllers, wireless communication modules, and/or other suitable components as desired may be housed within the housing chamber 110. Optionally, the electronics housing 106 may include one or more mounting features 112 on which the various electronics may be supported within the housing chamber 110. In other examples, the mounting features 112 may be omitted and the electronics need not be supported on mounting features 112 within the housing chamber 110. The electronics housing 106 may optionally include a rear mounting hub 116, and in various aspects the rear mounting hub 116 may be utilized to support the luminaire 100 at various locations and/or to attach the luminaire 100 to various devices (e.g., support poles, mounting brackets, etc.). As best illustrated in FIGS. 3 and 8, in some cases, the rear mounting hub 116 may include one or more apertures 114. In various examples, input power lines and/or other wiring may extend through the one or more apertures 114 to connect to one or more power sources (e.g., drivers) and/or other electronics within the housing chamber 110 for powering and controlling the luminaire 100. As a non-limiting example, drivers within the housing chamber 110 may convert line voltage, for example 110 volt or 220 volt alternating current (AC) power, to a lower voltage direct current (DC) power suitable for driving light sources such as LEDs.

The cover 108 may be removably secured over the electronics housing 106 to selectively enclose the housing chamber 110. The cover 108 may be removably secured to the electronics housing 106 via various suitable mechanical or chemical mechanisms as desired. In the example of FIGS.

1-21, fasteners 118 secure the cover 108 to the electronics housing 106 (see FIG. 4) by selectively engaging engagement features 119 such as bosses or other suitable features. In some cases, the cover 108 may be hinged to the electronics housing 106 on one side (e.g., proximate to the rear mounting hub 116 or at other locations as desired) so that the cover 108 can remain attached to the electronics housing 106 during servicing of the electronics within the housing chamber 110. However, it will be appreciated that a hinged attachment is not required, and various other suitable securing mechanisms may be utilized as desired that keep the cover 108 attached during servicing and/or allow for the cover 108 to be completely detached from the electronics housing 106. Optionally, a gasket (not shown) may be provided at the interface between the electronics housing 106 and the cover 108 that at least partially seals the housing chamber 110 when the cover 108 is secured to the electronics housing 106. In some aspects, the seal provided by the gasket may be an airtight seal to minimize and/or prevent dust and debris from entering the housing chamber 110 and detrimentally impacting the electronics housed within the housing chamber 110.

The electronics housing 106 and cover 108 may be constructed from various suitable materials as desired. In some cases, the electronics housing 106 and/or the cover 108 may be constructed from any metallic or polymeric material having suitable rigidity and suitable thermal management properties so as to effectively dissipate heat generated by the electronics housed within the housing chamber 110. As a non-limiting example, in some embodiments the electronics housing 106 and a cover 108 are constructed from metal, such as aluminum or steel. In some embodiments, the electronics housing 8 and/or cover 10 is formed of cast aluminum.

As best illustrated in FIGS. 5-9, one or more alignment extensions 120 extend from the electronics housing 106. While two alignment extensions 120 are illustrated, in other examples, a single alignment extension 120 or more than two alignment extensions 120 may be provided with the electronics housing 106. In certain aspects, the one or more alignment extensions 120 extend from a side wall of the electronics housing 106 opposite from the rear mounting hub 116, although they may be provided at other locations as desired and need not be opposite from the rear mounting hub 116. In some embodiments, the one or more alignment extensions 120 are recessed below a top surface 122 of the electronics housing 106. As discussed in detail below, a recessed ledge 150 may be formed in the top surface 122 to create a seating area 124 (see, e.g., FIG. 10) that can receive a portion of the light module 104. In other examples, the one or more alignment extensions 120 extend from the electronics housing 106 such that they are coplanar with a top surface 122 of the electronics housing 106.

Figure 21:
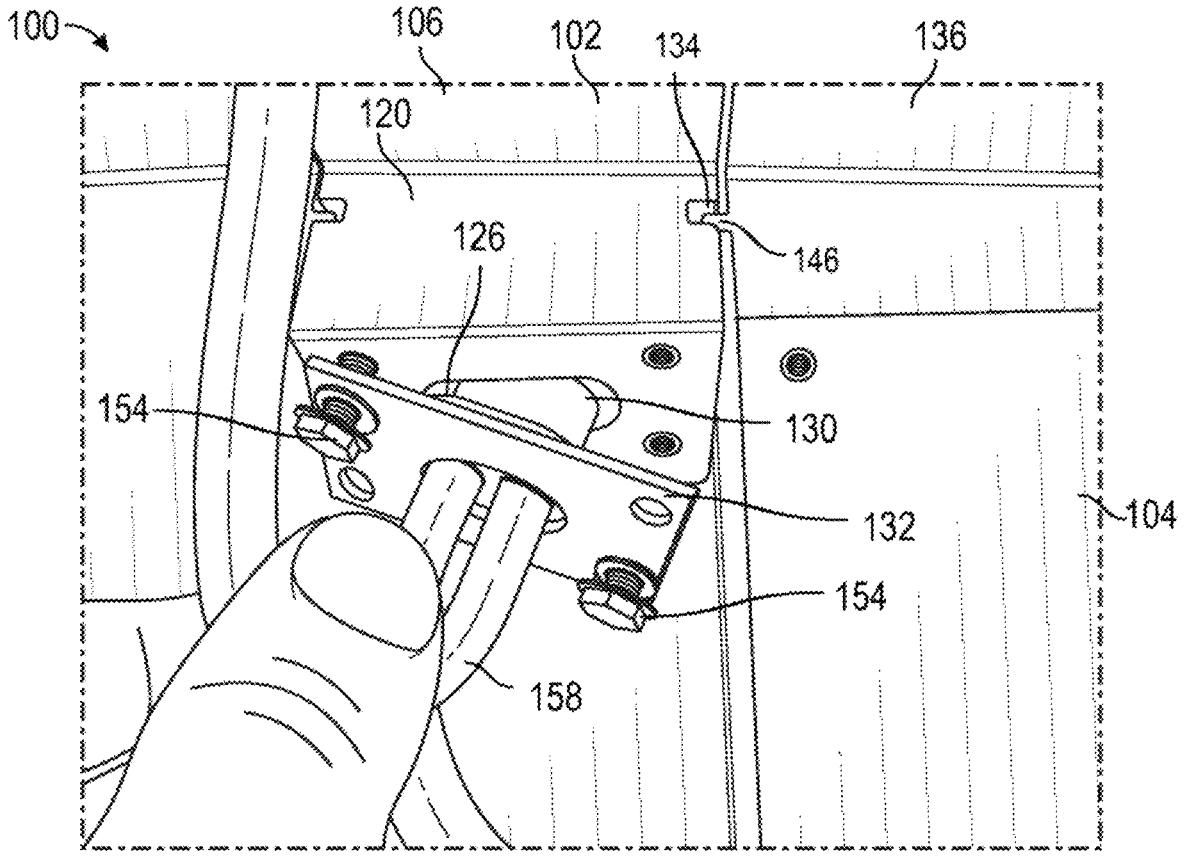
FIG. 21 is another perspective view of the portion of the luminaire of FIG. 1 showing the mating feature of the electronics module engaged with the mating feature of the light module.

Each alignment extension 120 includes at least one wireway channel 126. When assembled, wires, such as wires from light engines 128, can extend through the wireway channels 126. In various aspects, the wireway channels 126 may prevent or minimize potential damage to the wires (such as damage caused by wire pinching, etc.). As best illustrated in FIG. 21, a grommet 130 may optionally be positioned within each wireway channel 126 to protect the wires extending therethrough. The grommet 130 may optionally prevent or minimize dust and other debris from entering the wireway channel 126 and gaining access to the electronics housing 106. In some embodiments, the grommet 130 may be formed of a compressible material, such as rubber (e.g., silicone), although in various other examples the grommet 130 may be constructed from various other materials as desired. As discussed in more detail below, a compression plate 132 may also be used to ensure contact between the grommet 130 and the wires.

In various examples, one or more of the alignment extensions 120 may optionally include one or more alignment grooves 134. As discussed in more detail below, the alignment grooves 134 may engage alignment ribs on the light module 104 to facilitate alignment and positioning of the electronics housing 106 relative to the light module 104. It will be appreciated that in other examples, the electronics housing 106 may include the alignment rib(s) and the alignment groove(s) 134 may be provided on the light module 104.

The alignment grooves 134 may be provided on various portions and at various locations on the alignment extensions 120 as desired. In some cases, the alignment grooves 134 may extend along a complete perimeter of each alignment extension 120 or may extend along a portion of the alignment extension 120. As some non-limiting examples, the alignment extensions 120 may be provided on opposing sides and/or the top of each alignment extension 120. Accordingly, the location and number of alignment grooves 134 on each alignment extension 120 should not be considered limiting on the current disclosure. In the embodiment illustrated, the alignment grooves 134 are shown with a rectilinear cross-section shape; however, it will be appreciated that in other examples, the alignment grooves 134 but could have other shapes as desired, including, but not limited to curved, triangular, etc.

Light Module

As best illustrated in FIGS. 1-4 and 11-14, the light module 104 includes a housing 136 and one or more light engines 128 mounted to the underside of the housing 136. In various examples, the housing 136 may be a heat sink that provides thermal management properties so as to effectively dissipate heat generated by the light engines 128. In some examples, the housing 136 may be constructed from various suitable metallic or polymeric materials having suitable rigidity and suitable thermal management properties so as to effectively dissipate heat generated by the light engines 128. As a non-limiting example, in some embodiments the housing 136 may be formed from metal, such as aluminum or steel. In some embodiments, the housing 136 may be formed of cast aluminum.

Optionally, heat sink fins 138 may be, but do not have to be, provided on one or more surfaces of the housing 136. As a non-limiting example, one or more heat sink fins 138 may be provided on a top surface 140 of the housing 136. The shape, number, and/or configuration of the heat sink fins 138 should not be considered limiting on the current disclosure. Optionally, apertures 142 may be formed in and extend through the housing 136 at various locations as desired. When the luminaire 100 is used, heat generated by the light engines 128 may be conducted to the housing 136. Such heat may be subsequently conducted to the air circulating through the channels defined between adjacent heat sink fins 138. Additionally or alternatively, the heat may be conducted to the air circulating through the apertures 142 provided in the housing 136. The circulating air consequently heats up and rises, thereby carrying heat away from the luminaire 100 via convection.

In some embodiments, the light engines 128 include LEDs mounted on a printed circuit board ("PCB") and wired to the PCB. Any number of light engines 128 may be mounted on the housing 136, and the number of light engines 128 illustrated should not be considered limiting on the current disclosure. In some embodiments, each light engine 128 may include wiring for connecting to a driver, which can be shared between light engines 128 or each light engine 128 could have its own power supply. The LEDs may be single-die or multi-die LEDs, DC or AC, or can be organic light emitting diodes. White, color, or multicolor LEDs may be used. Moreover, the LEDs mounted on a PCB need not all be the same color; rather, mixtures of LEDs may be used. Furthermore, in some embodiments no PCB is needed; rather, the LEDs are chip-on-board LEDs provided directly on the underside of the housing 136. The light engines 128 may be retained on the housing 136 through various suitable mechanical or chemical mechanisms as desired. In one non-limiting example, fasteners such as screws are mechanical mechanisms that extend through the light engines 128 and engage the housing 136.

In some embodiments, an optic or lens (not shown) may be provided on the underside of the light module 104. When included, the optic or lens may direct light emitted from the light engines 128 and/or may enclose or seal the light module 104 from the outside or ambient environment. In other examples, the optic or lens may be omitted and the light module 104 may have an open design, meaning that the lens or optic is not positioned over the underside of the housing 136.

As best illustrated in FIGS. 3, 4, and 12-14, the housing 136 may include one or more alignment channels 144. The number and shape of the alignment channels 144 should not be considered limiting on the current disclosure. In certain examples, the number of alignment channels 144 corresponds with the number of alignment extensions 120 of the electronics module 102. In some examples, the shape of the alignment channels 144 may be complimentary to the shape of the alignment extensions 120. Each alignment channel 144 includes an alignment channel opening 148 in at least one of the sides of the housing 136. As discussed in greater detail below, a corresponding one of the alignment extensions 120 may be positioned in the alignment channel opening 148 and at least partially within the alignment channel 144. The alignment channels 144 may be provided at various locations on the light module 104 as desired. In the example of FIGS. 1-21, the alignment channels 144 are provided on an underside of the housing 136 opposite from the top surface 140. As discussed in greater detail below, each alignment channel 144 is configured to at least partially receive a corresponding one of the alignment extensions 120.

Optionally, each alignment channel 144 may include one or more alignment ribs 146 that selectively engage with the alignment grooves 134 of the corresponding alignment extension 120. In some cases, the alignment ribs 146 are provided in the alignment channels 144 proximate to the alignment channel openings 148, although they need not be in other examples. As mentioned, in other examples, the alignment grooves 134 may be provided with the alignment channels 144 and the alignment ribs 146 may be provided with the alignment extensions 120.

Figure 13:
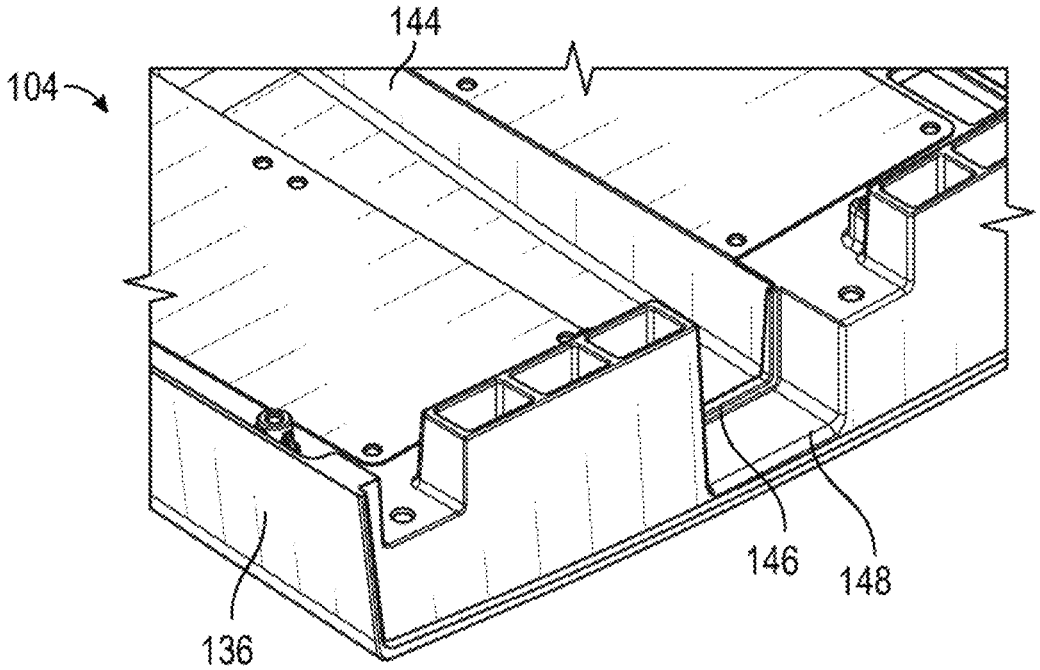
FIG. 13 is a perspective view of a portion of the light module of FIG. 1 with a mating feature according to embodiments of the disclosure.
Figure 14:
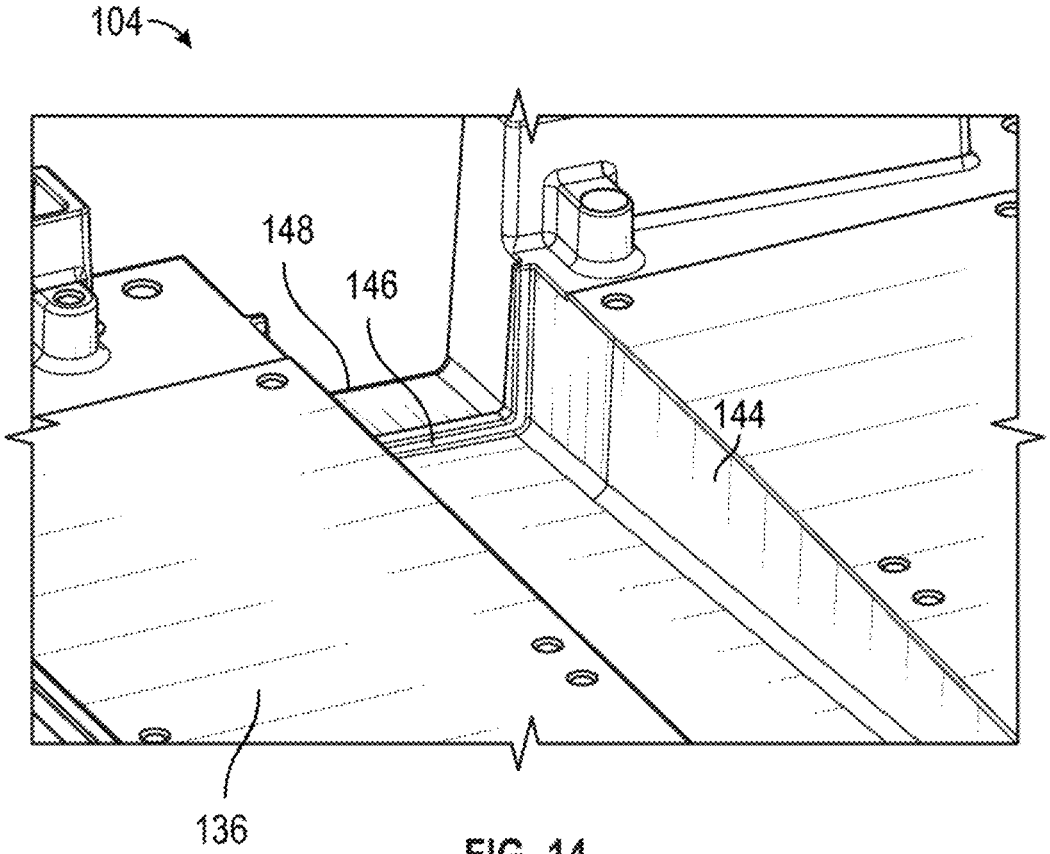
FIG. 14 is another perspective view of the portion of the light module with the mating feature of FIG. 13.

As best illustrated in FIG. 13, in various examples, an end or side of the housing 136 may include a lip 152 that may be seated within the seating area 124 on the ledge 150 of the electronics housing 106. As discussed in detail below, the positioning of the lip 152 relative to the ledge 150 may further minimize or prevent environmental elements from entering the luminaire 100 when assembled.

Assembly

Referring to FIGS. 15-21, the light module 104 may be assembled with the electronics housing 106 to assemble the luminaire 100. In various examples, each alignment extension 120 of the electronics housing 106 is positioned at least partially within a corresponding one of the alignment channels 144 of the housing 136 of the light module 104. In certain aspects, the alignment extensions 120 are positioned within the alignment channels 144 such that the alignment rib 146 within each alignment channel 144 engages the alignment groove 134 of each alignment extension 120. The engagement between the alignment ribs 146 and alignment grooves 134 may ensure proper alignment between the electronics housing 106 and housing 136 of the light module 104. The engagement between the alignment ribs 146 and the alignment grooves 134 may also create an interlocking relationship between the electronics housing 106 and the light module 104 that minimizes or prevents their relative movement when the luminaire 100 is assembled. Optionally, when the alignment extensions 120 are positioned within the alignment channels 144, various suitable fasteners (not illustrated) including, but not limited to, screws, bolts, pins, clips, or other fasteners, may be used to further secure the electronics housing 106 and the light module 104 together. In other examples, such additional fasteners may not be needed, and the engagement of the alignment extensions 120 with the alignment channels 144 may provide a sufficient engagement to secure the electronics housing 106 with the light module 104.

Figure 15:
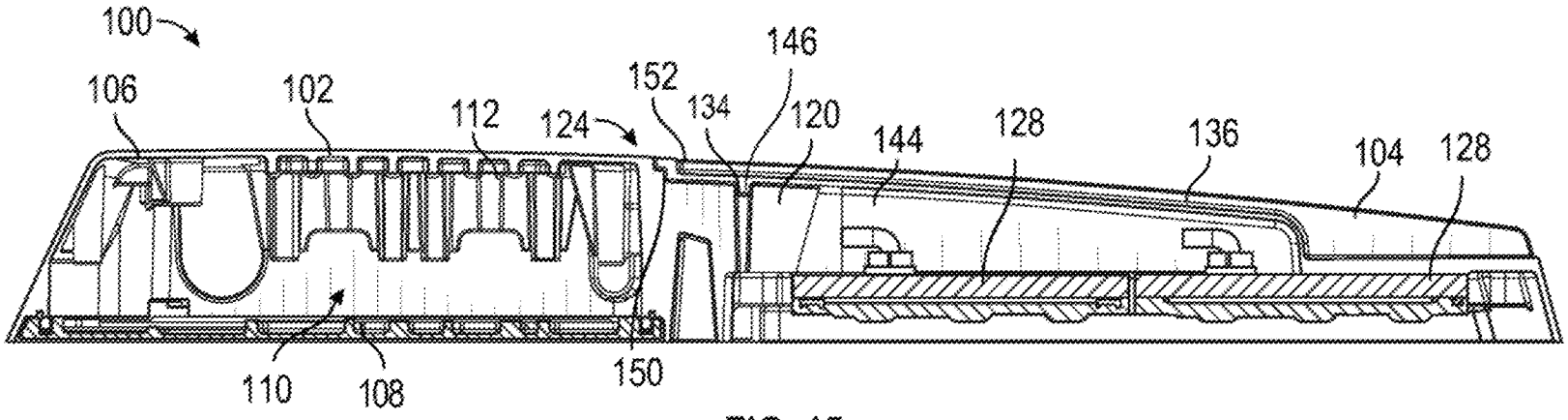
FIG. 15 is a sectional view of the luminaire of FIG. 1 taken along line 15-15 in FIG. 2.
Figure 16:
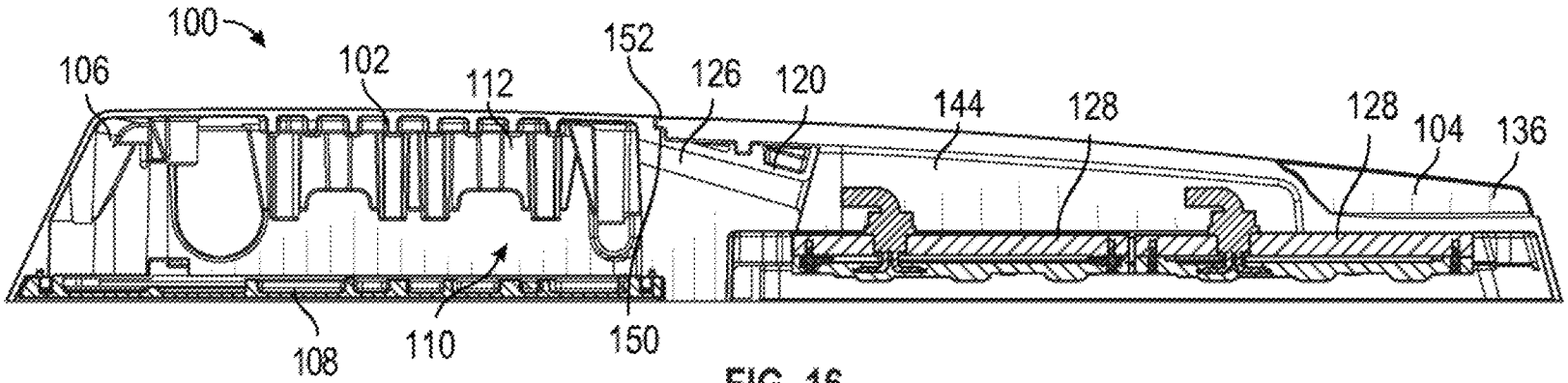
FIG. 16 is a sectional view of the luminaire of FIG. 1 taken along line 16-16 in FIG. 2.
Figure 17:
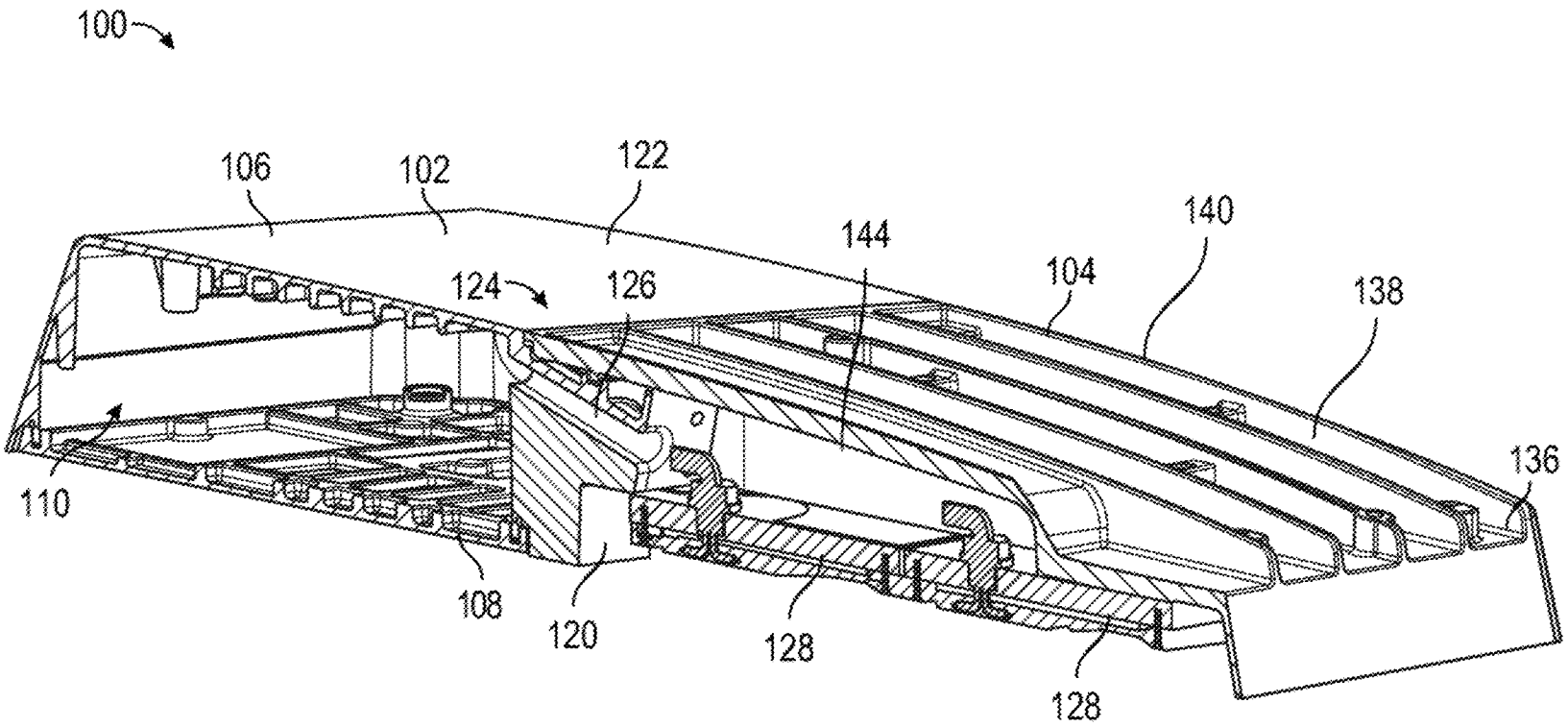
FIG. 17 is a perspective sectional view of the luminaire of FIG. 1 taken along line 16-16 in FIG. 2.
Figure 18:
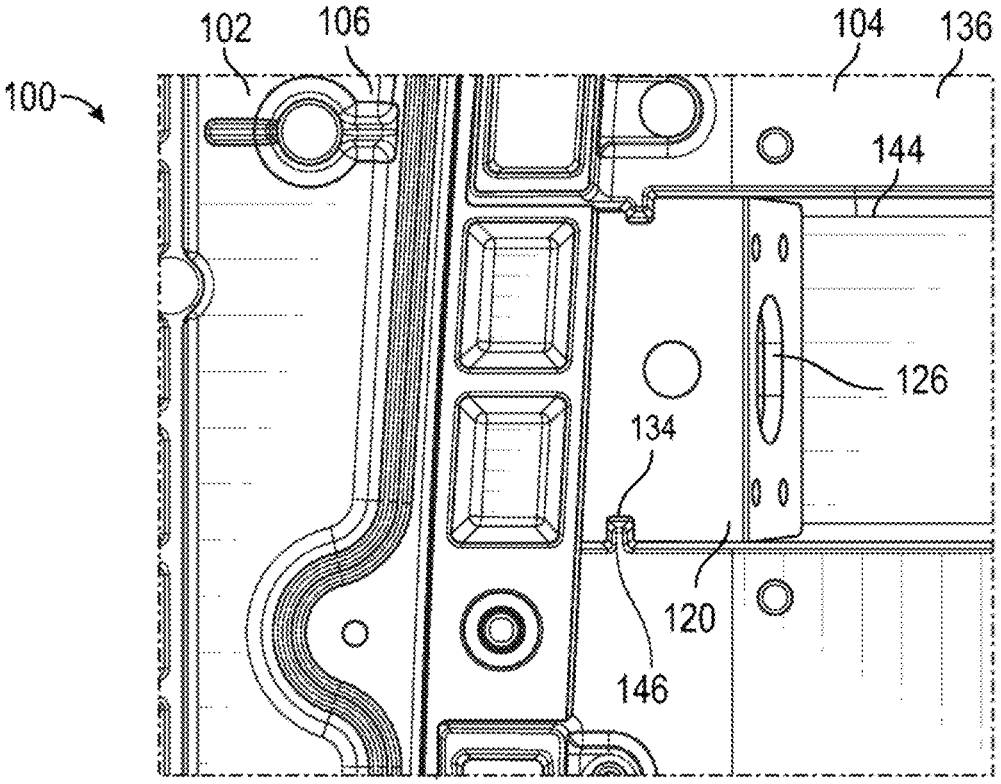
FIG. 18 is a top view a portion of the luminaire of FIG. 1 showing the mating feature of the electronics module engaged with the mating feature of the light module.
Figure 19:
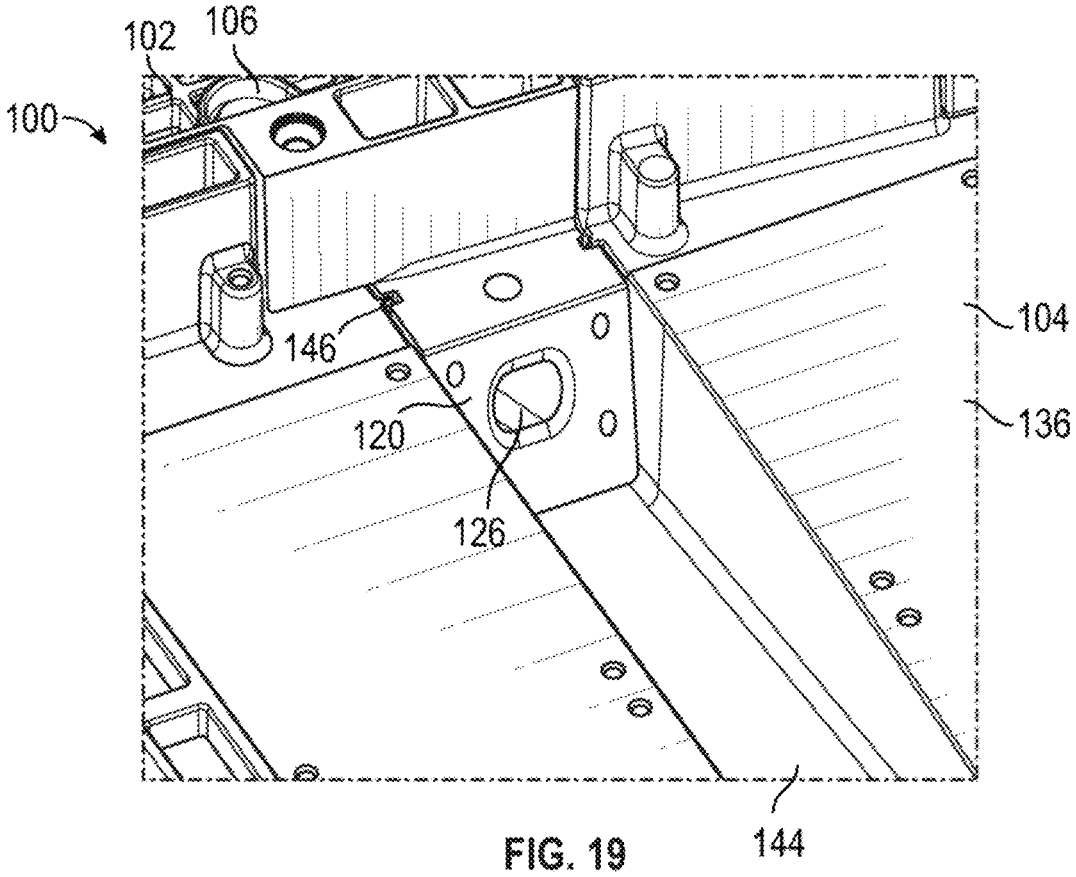
FIG. 19 is a perspective view of the portion of the luminaire of FIG. 1 showing the mating feature of the electronics module engaged with the mating feature of the light module.
Figure 20:
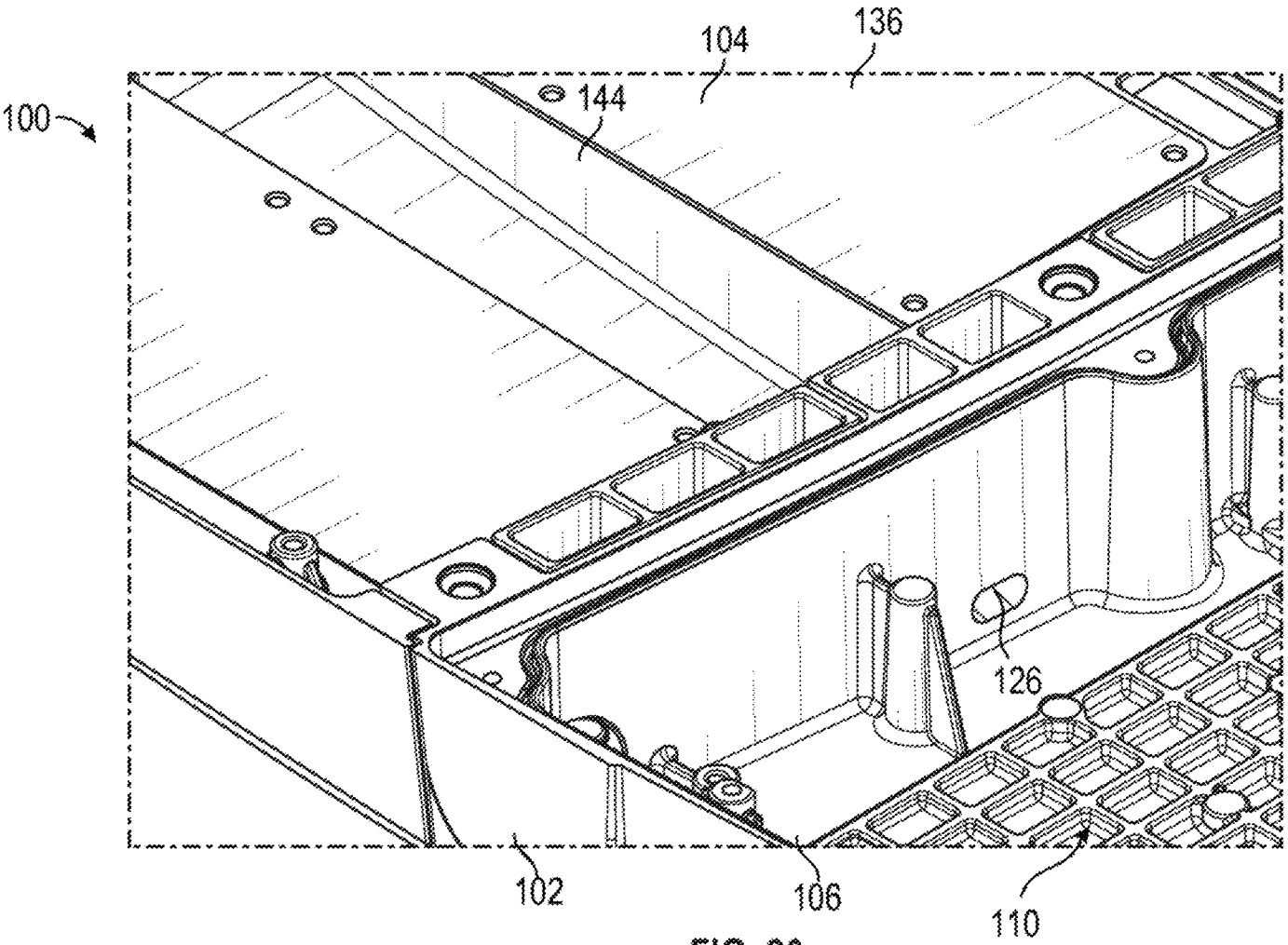
FIG. 20 is another perspective view of the portion of the luminaire of FIG. 1 showing the mating feature of the electronics module engaged with the mating feature of the light module.

In some cases, and as best illustrated in FIGS. 15-17, when the luminaire 100 is assembled, the lip 152 of the housing 136 of the light module 104 may be seated on the ledge 150 and within the seating area 124 of the electronics housing 106. The lip 152 seated within the seating area 124 may at least partially overlap the ledge 150. This overlap feature between the electronics module 102 and light module 104 may further assist in positioning and orienting the light module 104 relative to the electronics housing 106. The overlap between the lip 152 and the ledge 150 may provide additional ingress protection and may minimize or prevent environmental hazards from directly hitting any potential entry points to the electronics housing 106.

In some embodiments, the top surface 122 of the electronics housing 106 and the top surface 140 of the housing 136 of the light module 104 may be flush when the luminaire is assembled. In certain aspects, the top surface 122 is coplanar with the top surface 140, but it will be appreciated that depending on the shape of the light module 104 and the electronics housing 106, the top surface 122 can be flush with the top surface 140 without necessarily being coplanar. In further examples, the top surface 122 need not be flush with the top surface 140. Regardless, attachment of the light module 104 to the electronics module 102 creates a single seam into which environmental elements such as water, dust, sand, etc. can potentially gain ingress into the luminaire 100. Furthermore, to the extent water and/or other environmental hazards to the luminaire 100 are able to penetrate into the luminaire 100, the alignment ribs 146 serve as a barrier that minimizes or prevents ingress of water or other hazards beyond the alignment ribs 146, and the alignment grooves 134 may serve as drainage channels to guide the water out of the luminaire 100.

Referring to FIG. 21, to install the light engines 128, the grommet 130 and compression plate 132 are routed over wire(s) 158 extending from the light engines 128 such that the wires 158 extend through the grommet 130. The wires 158 and grommet 130 may then be inserted into the wireway channel 126 of an alignment extension 120. The compression plate 132 may be positioned around the grommet 130 and mounted to the end face of the alignment extension 120 via fasteners 154 (such as screws or other suitable fasteners as desired). In various aspects, tightening of the fasteners 154 may draw the compression plate 132 tighter against the alignment extension 120 and the grommet 130 further into the wireway channel 126 to thereby compresses the grommet 130 against the wires to create a better seal. The necessary electrical connections between the wires 158 of the light engines 128 and the drivers are then made in the electronics module 102 to connect driver output to LED input.

Figure 4:
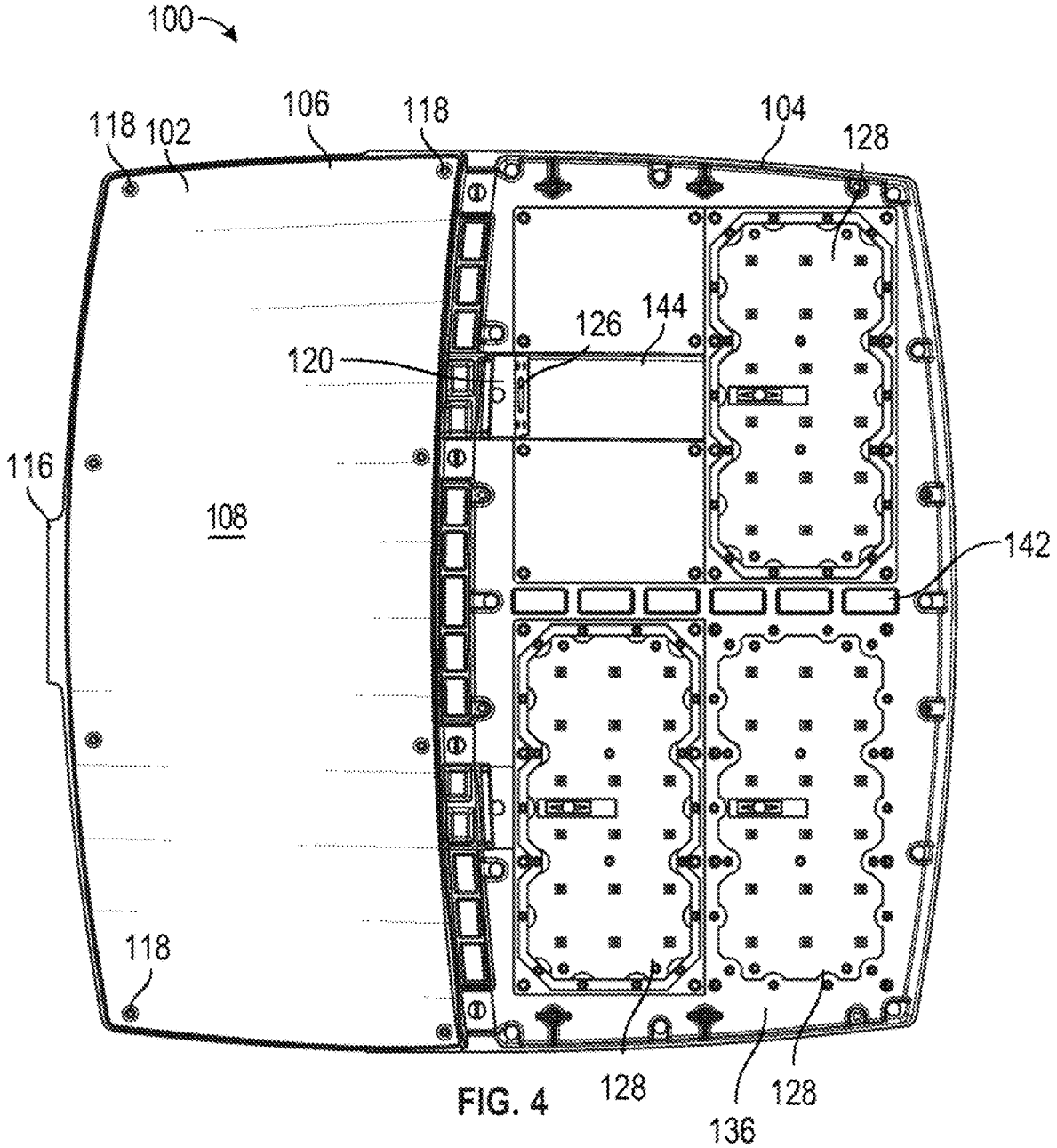
FIG. 4 is a bottom plan view of the luminaire of FIG. 1.
Figure 5:
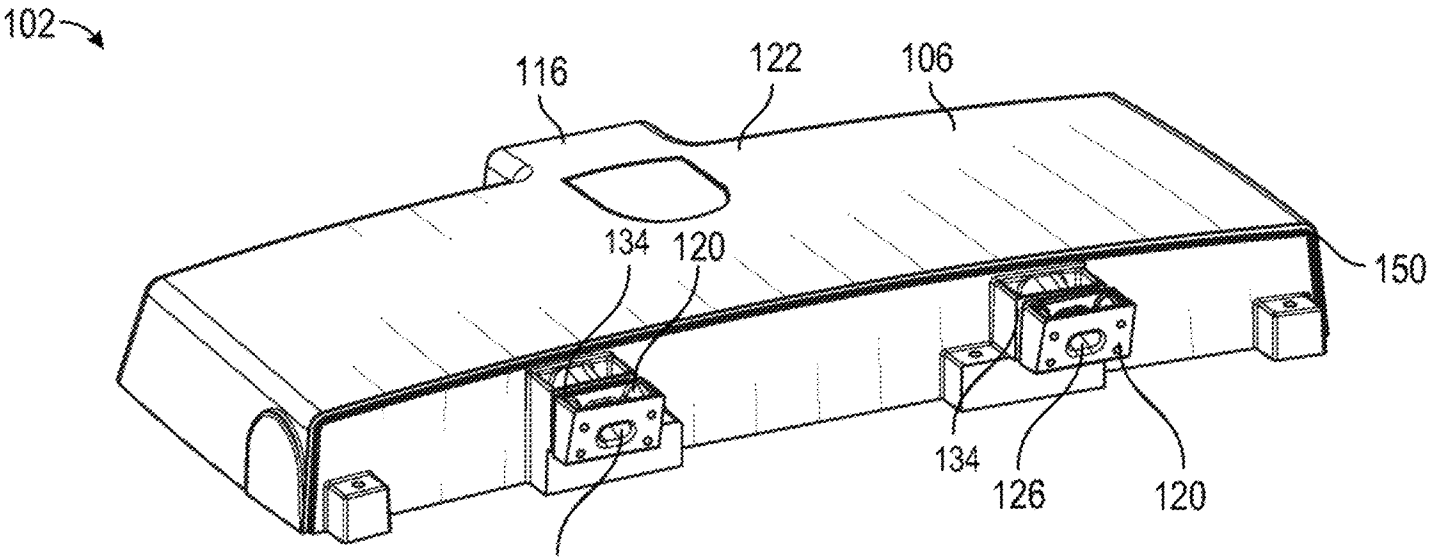
FIG. 5 is a perspective view of the electronics module of FIG. 1.
Figure 6:
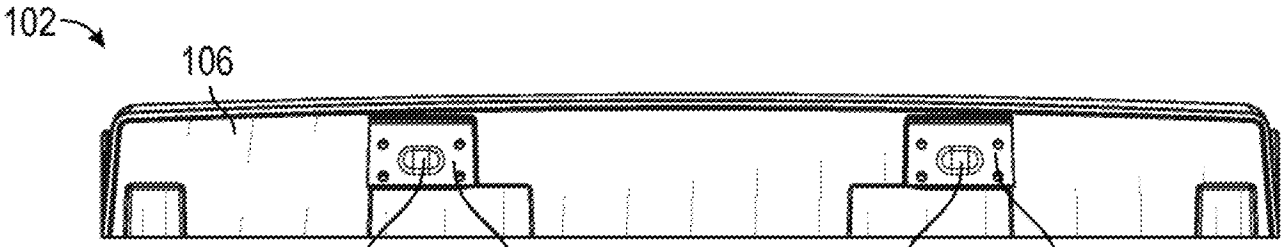
FIG. 6 is an end view of the electronics module of FIG. 1.
Figure 7:
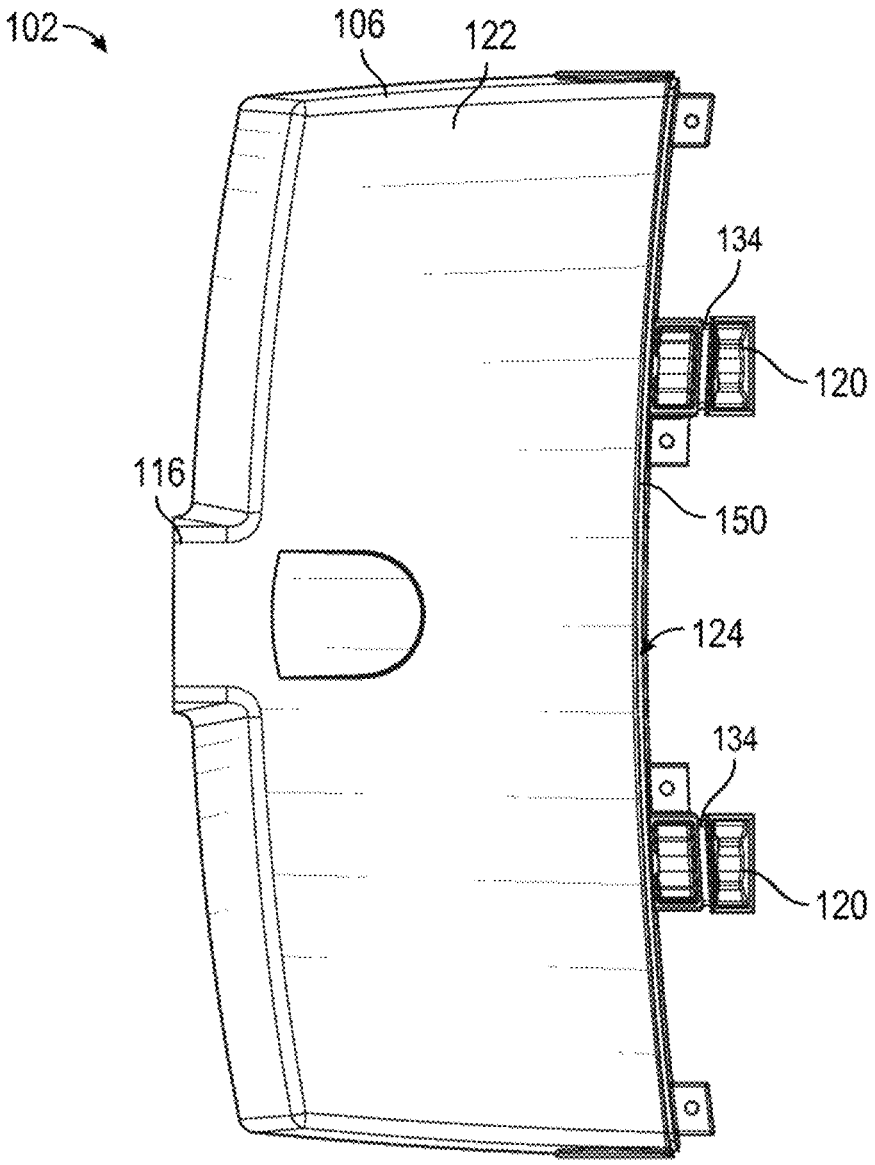
FIG. 7 is a top plan view of the electronics module of FIG. 1.

The light engines 128 may be secured to the housing 136 of the light module 104 via fasteners such as screws or other suitable fasteners as desired. The wires 158 from the light engines 128 are positioned within the alignment channels 146 and extend into the wireway channels 126 of the alignment extensions 120. When the light engines 128 are mounted, the light engines 128 may extend over the alignments channels 144 to thereby cover and protect the wires as well as the opening 148 of the alignment channels 144. FIG. 4 illustrates the light module 104 with one of the light engines 128 removed to show the otherwise covered alignment channels 144. The light engines 128 covering the alignment channels 144 may further improve ingress protection at the wire entry points and may minimize or eliminates undesirable aesthetics (exposed hardware or wiring) without the need for additional cosmetic components to conceal the undesirable aesthetic features/additional parts.

The luminaire 100 may be pole-mounted, side-mounted, or otherwise mounted or supported at a location as desired. Various mechanisms and devices may be used to support the luminaire 100 in a particular location and/or orientation, including, but not limited to, a mounting bracket or yoke, a slip fitter that slips over the end of a mounting pole, and/or a knuckle. In some cases, the mounting mechanisms may enable the orientation of the luminaire 100 to be adjusted (either pivotably, rotationally, or both).

Examples

A collection of exemplary embodiments, including at least some explicitly enumerated as "Examples" providing additional description of a variety of example types in accordance with the concepts described herein are provided below. These examples are not meant to be mutually exclusive, exhaustive, or restrictive; and the invention is not limited to these example examples but rather encompasses all possible modifications and variations within the scope of the issued claims and their equivalents.

Example 1. A luminaire comprising an electronics module and a light module attached to the electronics module, wherein: the electronics module comprises an electronics housing and a cover attached to the electronics housing to form an enclosure within the electronics module; at least one alignment extension extends from the electronics housing; at least one wireway channel comprising an opening extends through the at least one alignment extension; the light module comprises a heat sink and a light engine comprising at least one light source and at least one wire; at least one alignment channel is formed in an underside of the heat sink; the at least one alignment extension is positioned within the at least one alignment channel; the light engine is attached to the underside of the heat sink and extends over at least a portion of the at least one alignment channel so as to conceal the opening of the at least one wireway channel; and the at least one wire extends through the at least one wireway channel.

Example 2. A luminaire comprising: an electronics module comprising: an electronics housing defining a housing chamber; a cover attached to the electronics housing such that the housing chamber is enclosed; and at least one alignment extension extending outwardly from the electronics housing; and a light module attached to the electronics module, the light module comprising: a light module housing; at least one alignment channel in the light module housing, wherein the at least one alignment extension is at least partially positioned within the at least one alignment channel; and a light engine comprising at least one light source, wherein the light engine is attached to the light module housing and extends over and covers at least a portion of the at least one alignment channel so as to enclose the portion of the at least one alignment channel.

Example 3. The luminaire of any of the preceding or subsequent examples or combination of examples, wherein the at least one alignment extension comprises a wireway channel extending through the at least one alignment extension and in fluid communication with the housing chamber and the at least one alignment channel, wherein the light engine further comprises at least one wire, and wherein the at least one wire extends through the wireway channel.

Example 4. The luminaire of any of the preceding or subsequent examples or combination of examples, further comprising: an alignment rib on one of the at least one alignment extension or the at least one alignment channel; and an alignment groove on the other of the at least one alignment extension or the at least one alignment channel, wherein the alignment rib is engaged with the alignment groove.

Example 5. The luminaire of any of the preceding or subsequent examples or combination of examples, wherein the alignment rib is on the at least one alignment channel and wherein the alignment groove is on the at least one alignment extension.

Example 6. The luminaire of any of the preceding or subsequent examples or combination of examples, wherein the electronics housing comprises a top surface, wherein the at least one alignment extension extends outwardly from a side wall of the electronics housing, and wherein the top surface comprises a recessed ledge proximate the side wall that defines a seating area.

Example 7. The luminaire of any of the preceding or subsequent examples or combination of examples, wherein the light module housing further comprises a lip extending from the light module housing, and wherein the lip is seated within the seating area such that the lip at least partially overlaps the recessed ledge of the light module housing.

Example 8. The luminaire of any of the preceding or subsequent examples or combination of examples, wherein the light module further comprises at least one of: at least one heat sink fin; or at least one aperture extending through the light module housing.

Example 9. A luminaire comprising: an electronics module comprising: an electronics housing defining a housing chamber; and at least one alignment extension extending outwardly from the electronics housing, wherein the at least one alignment extension comprises a wireway channel extending through the at least one alignment extension and that is fluid communication with the housing chamber; and a light module attached to the electronics module, the light module comprising: a light module housing; at least one alignment channel in the light module housing, wherein the at least one alignment extension is at least partially positioned within the at least one alignment channel; and a light engine comprising at least one light source and at least one wire, wherein the at least one wire extends through the wireway channel.

Example 10. The luminaire of any of the preceding or subsequent examples or combination of examples, wherein the electronics module further comprises a cover, and wherein the cover is attached to the electronics housing such that the housing chamber is enclosed.

Example 11. The luminaire of any of the preceding or subsequent examples or combination of examples, further comprising: an alignment rib on one of the at least one alignment extension or the at least one alignment channel; and an alignment groove on the other of the at least one alignment extension or the at least one alignment channel, wherein the alignment rib is engaged with the alignment groove.

Example 12. The luminaire of any of the preceding or subsequent examples or combination of examples, wherein the light engine is attached to the light module housing and extends over and covers at least a portion of the at least one alignment channel so as to enclose the portion of the at least one alignment channel.

Example 13. The luminaire of any of the preceding or subsequent examples or combination of examples, wherein: the electronics housing comprises a top surface; the at least one alignment extension extends outwardly from a side wall of the electronics housing; the top surface comprises a recessed ledge proximate the side wall that defines a seating area; the light module housing further comprises a lip extending from the light module housing; and the lip is seated within the seating area such that the lip at least partially overlaps the recessed ledge of the electronics housing.

Example 14. The luminaire of any of the preceding or subsequent examples or combination of examples, wherein the at least one alignment extension comprises at least two alignment extensions, and wherein the at least one alignment channel comprises at least two alignment channels.

Example 15. A luminaire comprising: an electronics module comprising: an electronics housing defining a housing chamber; and at least one alignment extension extending outwardly from the electronics housing; a light module attached to the electronics module, the light module comprising: a light module housing; at least one alignment channel in the light module housing, wherein the at least one alignment extension is at least partially positioned within the at least one alignment channel; an alignment rib on one of the at least one alignment extension or the at least one alignment channel; and an alignment groove on the other of the at least one alignment extension or the at least one alignment channel opposite from the alignment rib, wherein the alignment rib is engaged with the alignment groove.

Example 16. The luminaire of any of the preceding or subsequent examples or combination of examples, wherein the at least one alignment extension comprises a wireway channel extending through the at least one alignment extension and that is fluid communication with the housing chamber and the at least one alignment channel, wherein the light module further comprises a light engine comprising at least one light source and at least one wire, wherein the at least one wire extends through the wireway channel.

Example 17. The luminaire of any of the preceding or subsequent examples or combination of examples, wherein the alignment rib is on the at least one alignment channel and wherein the alignment groove is on the at least one alignment extension.

Example 18. The luminaire of any of the preceding or subsequent examples or combination of examples, wherein the light module further comprises a light engine comprising at least one light source, and wherein the light engine is attached to the light module housing and extends over and covers at least a portion of the at least one alignment channel so as to enclose the portion of the at least one alignment channel.

Example 19. The luminaire of any of the preceding or subsequent examples or combination of examples, wherein the light engine is a first light engine and the portion of the at least one alignment channel is a first portion, wherein the light module further comprises a second light engine comprising at least one light source, and wherein the second light engine is attached to the light module housing and extends over and covers a second portion of the at least one alignment channel so as to enclose the second portion of the at least one alignment channel.

Example 20. The luminaire of any of the preceding or subsequent examples or combination of examples, wherein: the electronics housing comprises a top surface; the at least one alignment extends from a side wall of the electronics housing; the top surface comprises a recessed ledge that defines a seating area; the housing of the light module further comprises a lip extending from the light module housing; and the lip is seated within the seating area such that the lip at least partially overlaps the recessed ledge of the electronics housing.

Example 21. The luminaire of any of the preceding or subsequent examples or combination of examples, wherein the light module housing further comprises a top surface, and wherein the top surface of the light module is flush with the top surface of the electronics housing.

Different arrangements of the components depicted in the drawings or described above, as well as components and steps not shown or described are possible. Similarly, some features and sub-combinations are useful and may be employed without reference to other features and sub-combinations. Examples of the invention have been described for illustrative and not restrictive purposes, and alternative examples will become apparent to readers of this patent. Accordingly, the present invention is not limited to the examples described above or depicted in the drawings, and various examples and modifications may be made without departing from the scope of the claims below.

That which is claimed:

1. A luminaire comprising:

an electronics module comprising:

an electronics housing defining a housing chamber;

a cover attached to the electronics housing such that the housing chamber is enclosed; and at least one alignment extension extending outwardly from the electronics housing; and a light module attached to the electronics module, the light module comprising:

a light module housing;

at least one alignment channel in the light module housing, wherein the at least one alignment extension is at least partially positioned within the at least one alignment channel; and a light engine comprising at least one light source, wherein the light engine is attached to the light module housing and extends over and covers at least a portion of the at least one alignment channel so as to enclose the portion of the at least one alignment channel.

2. The luminaire of claim 1, wherein the at least one alignment extension comprises a wireway channel extending through the at least one alignment extension and in fluid communication with the housing chamber and the at least one alignment channel, wherein the light engine further comprises at least one wire, and wherein the at least one wire extends through the wireway channel.

3. The luminaire of claim 1, further comprising:

an alignment rib on one of the at least one alignment extension or the at least one alignment channel; and an alignment groove on the other of the at least one alignment extension or the at least one alignment channel, wherein the alignment rib is engaged with the alignment groove.

4. The luminaire of claim 3, wherein the alignment rib is on the at least one alignment channel and wherein the alignment groove is on the at least one alignment extension.

5. The luminaire of claim 1, wherein the electronics housing comprises a top surface, wherein the at least one alignment extension extends outwardly from a side wall of the electronics housing, and wherein the top surface comprises a recessed ledge proximate the side wall that defines a seating area.

6. The luminaire of claim 5, wherein the light module housing further comprises a lip extending from the light module housing, and wherein the lip is seated within the seating area such that the lip at least partially overlaps the recessed ledge of the light module housing.

7. The luminaire of claim 1, wherein the light module further comprises at least one of:

at least one heat sink fin; or at least one aperture extending through the light module housing.

8. A luminaire comprising:

an electronics module comprising:

an electronics housing defining a housing chamber; and at least one alignment extension extending outwardly from the electronics housing, wherein the at least one alignment extension comprises a wireway channel extending through the at least one alignment extension and that is fluid communication with the housing chamber; and a light module attached to the electronics module, the light module comprising:

a light module housing;

at least one alignment channel in the light module housing, wherein the at least one alignment extension is at least partially positioned within the at least one alignment channel; and a light engine comprising at least one light source and at least one wire, wherein the at least one wire extends through the wireway channel.

9. The luminaire of claim 8, wherein the electronics module further comprises a cover, and wherein the cover is attached to the electronics housing such that the housing chamber is enclosed.

10. The luminaire of claim 8, further comprising:

an alignment rib on one of the at least one alignment extension or the at least one alignment channel; and an alignment groove on the other of the at least one alignment extension or the at least one alignment channel, wherein the alignment rib is engaged with the alignment groove.

11. The luminaire of claim 8, wherein the light engine is attached to the light module housing and extends over and covers at least a portion of the at least one alignment channel so as to enclose the portion of the at least one alignment channel.

12. The luminaire of claim 8, wherein:

the electronics housing comprises a top surface;

the at least one alignment extension extends outwardly from a side wall of the electronics housing;

the top surface comprises a recessed ledge proximate the side wall that defines a seating area;

the light module housing further comprises a lip extending from the light module housing; and the lip is seated within the seating area such that the lip at least partially overlaps the recessed ledge of the electronics housing.

13. The luminaire of claim 8, wherein the at least one alignment extension comprises at least two alignment extensions, and wherein the at least one alignment channel comprises at least two alignment channels.

14. A luminaire comprising:

an electronics module comprising:

an electronics housing defining a housing chamber; and at least one alignment extension extending outwardly from the electronics housing;

a light module attached to the electronics module, the light module comprising:

a light module housing;

at least one alignment channel in the light module housing, wherein the at least one alignment extension is at least partially positioned within the at least one alignment channel;

an alignment rib on one of the at least one alignment extension or the at least one alignment channel; and an alignment groove on the other of the at least one alignment extension or the at least one alignment channel opposite from the alignment rib, wherein the alignment rib is engaged with the alignment groove.

15. The luminaire of claim 14, wherein the at least one alignment extension comprises a wireway channel extending through the at least one alignment extension and that is fluid communication with the housing chamber and the at least one alignment channel, wherein the light module further comprises a light engine comprising at least one light source and at least one wire, wherein the at least one wire extends through the wireway channel.

16. The luminaire of claim 14, wherein the alignment rib is on the at least one alignment channel and wherein the alignment groove is on the at least one alignment extension.

17. The luminaire of claim 14, wherein the light module further comprises a light engine comprising at least one light source, and wherein the light engine is attached to the light module housing and extends over and covers at least a portion of the at least one alignment channel so as to enclose the portion of the at least one alignment channel.

18. The luminaire of claim 17, wherein the light engine is a first light engine and the portion of the at least one alignment channel is a first portion, wherein the light module further comprises a second light engine comprising at least one light source, and wherein the second light engine is attached to the light module housing and extends over and covers a second portion of the at least one alignment channel so as to enclose the second portion of the at least one alignment channel.

19. The luminaire of claim 14, wherein:

the electronics housing comprises a top surface;

the at least one alignment extends from a side wall of the electronics housing;

the top surface comprises a recessed ledge that defines a seating area;

the housing of the light module further comprises a lip extending from the light module housing; and the lip is seated within the seating area such that the lip at least partially overlaps the recessed ledge of the electronics housing.

20. The luminaire of claim 19, wherein the light module housing further comprises a top surface, and wherein the top surface of the light module is flush with the top surface of the electronics housing.

* * * * *